US006049079A

United States Patent [19]

Noordam et al.

[11] Patent Number: 6,049,079

[45] Date of Patent: Apr. 11, 2000

[54] APPARATUS FOR DETECTING A PHOTON PULSE

[75] Inventors: Lambertus Dominicus Noordam, Amsterdam; Marcelis Dominicus Lankhuijzen, Diemen, both of Netherlands

[73] Assignee: Stichting Voor Fundamenteel Onderzoek Der Materie, Utrecht, Netherlands

[21] Appl. No.: 08/945,080

[22] PCT Filed: Apr. 21, 1996

[86] PCT No.: PCT/NL96/00081

§ 371 Date: Oct. 20, 1997

§ 102(e) Date: Oct. 20, 1997

[87] PCT Pub. No.: WO96/33508

PCT Pub. Date: Oct. 24, 1996

[30] Foreign Application Priority Data

Apr. 21, 1995 [NL] Netherlands ..... 1000198

[51] Int. Cl.[7] ..... H01J 31/50; G04F 13/02

[52] U.S. Cl. ..... 250/338.1; 250/214 VT; 250/374

[58] Field of Search ..... 250/338.1, 339.05, 250/374, 379, 214 VT; 348/215; 359/333

[56] References Cited

U.S. PATENT DOCUMENTS

| | | | |
|---|---|---|---|
| 4,814,599 | 3/1989 | Wang | 250/213 |
| 4,958,231 | 9/1990 | Tsuchiya | 250/214 VT |
| 4,988,859 | 1/1991 | Tsuchiya et al. | 250/214 VT |
| 5,311,010 | 5/1994 | Kruger | 250/214 |

OTHER PUBLICATIONS

Applied Physics Letters, Apr. 15, 1984, USA vol. 44, No. 8, ISSN 0003–6951, pp. 718–720, XP002004345 Yen R et al: "Low jitter streak camera triggered by subpicosecond laser pulses" cited in the application.

*Primary Examiner*—Edward P. Westin
*Assistant Examiner*—Richard Hanig
*Attorney, Agent, or Firm*—Michael D. Bednarek; Crowell & Moring LLP

[57] ABSTRACT

Streak camera whereof the pulse converter for converting a photon pulse for detecting into an electron stream comprises a gaseous medium. A streak camera for a photon pulse in the far-infrared region is provided with a laser source to bring particles in the medium into a Rydberg state, in a streak camera for an X-ray pulse the medium contains particles for bringing into an Auger state, and additional deflection plates are provided for separating a primary electron stream from a secondary electron stream.

15 Claims, 4 Drawing Sheets

APPARATUS FOR DETECTING A PHOTON PULSE

The invention relates to an apparatus for detecting a photon pulse as a function of time, for instance a streak camera, comprising a pulse converter for converting a photon pulse for detecting into an electron stream, first deflection means for deflecting the electron stream as a function of time and a position-sensitive detector for determining the deflection of the electron stream.

Such an invention is known from a publication by R. Yen, P. M. Downey, C. V. Shank and D. H. Auston in "Appl. Phys. Lett.", Vol. 44, No. 8, (1984), pp. 718–720. In this publication a streak camera is described, the streak tube (image-converter tube) of which contains a photocathode, a collimator plate provided with micro-channels, deflection plates and a phosphor screen. The output image of this streak tube is coupled via a reducing bundle of optical fibres to an image amplifier, the output of which is coupled using a fibre optic to a silicon image amplifier, the output signal of which is displayed on the screen of an optical multi-channel analyzer (OMA).

A photon pulse incident on the photocathode generates an electron beam which is deflected by the deflection plates, to which is applied a voltage which rapidly increases synchronously with the incidence of the photon pulse. The deflected electron beam strikes the phosphor screen, on which is displayed a line segment progressing in time, the intensity of which corresponds to the intensity of the incident photon pulse. This image is further processed by the relevant fibre optics, image amplifiers and OMA, whereafter an image of the intensity of the incident photon pulse as a function of time is finally obtained.

The known streak camera has the drawback that the wavelength range of photons of which the pulse intensity can be displayed is bounded on the long-wave side of the spectrum at a wavelength of approximately 1.5 $\mu$m (infrared), while on the other side photons from the X-ray region (i.e. the part of the spectrum having very short wavelengths) occur in many practical applications in non-monochromatic pulses, of which no sharp image can be made using an apparatus of the above described type.

The object of the invention is to provide an apparatus for detecting as a function of time a photon pulse which has a wavelength shorter than that of visible light or longer than that of infrared light and for making a sharp image of such a pulse.

This object is achieved with an apparatus of the type stated in the preamble, wherein according to the invention the pulse converter comprises a gaseous medium for absorbing the photon pulse to be detected and for emitting the electron stream.

In an apparatus wherein according to the invention the pulse converter comprises a gaseous medium the spectral range of a photon pulse for detecting is not limited to the visible light and the infrared region, but the spectral range can be extended as required to the wavelength region of far-infrared light or the wavelength region of X radiation.

In an embodiment of an apparatus according to the invention for detecting a photon pulse in the far- infrared region the apparatus is provided with excitation means for bringing particles into an excited electron state and the gaseous medium contains particles for bringing into this excited electron state in order in this state to absorb the photon pulse and to emit the electron stream.

The excited electron state is for instance a Rydberg state.

By bringing particles, for instance atoms, into an excited electron state, for instance a Rydberg state, a pulse converter is obtained for converting a (far) infrared and therefore low-energy photon pulse into an electron stream. An atom in a Rydberg state, referred hereinafter to as Rydberg atom, has a high value of the main quantum number n, and therefore a relatively low binding energy E ($E=-13.6/n^2$ eV). As a consequence the relatively low energy of a far-infrared photon is sufficiently high to cause photo-ionization of an atom in a Rydberg state and to liberate a weakly bonded electron from that atom. Moreover, the active cross-section for photo-ionization is high for a gas with Rydberg atoms, so that relatively few photons are required for this process.

A gaseous medium comprising particles for bringing into an excited state is for instance admitted into the apparatus via a gas supply line.

In one embodiment the apparatus according to the invention comprises an evaporation oven for bringing into a gaseous state the particles for bringing into an excited electron state.

Atoms for bringing into an excited electron state which are suitable for use in an apparatus according to the invention are for instance alkali atoms, in particular the elements Rb (rubidium) or Cs (caesium).

The atoms are brought into an excited electron state for instance by excitation using a laser light source.

A laser light source for use in an apparatus according to the invention is for instance a dye laser pumped with an Nd:YAG(neodymium:yttrium-aluminium garnet) laser. The second harmonic of the light of an Nd:YAG laser is particularly suitable for pumping the dye laser in such an apparatus.

In another embodiment the apparatus comprises a diode laser.

The invention further provides an apparatus for detecting a photon pulse in the infrared region as a function of time, comprising a pulse converter for converting a photon pulse for detecting into an electron stream and a detector for this electron stream, which apparatus is provided with excitation means for bringing particles into an excited electron state, wherein the pulse converter comprises a gaseous medium having particles for bringing into this excited electron state in order to absorb the photon pulse and to emit the electron stream.

Such an apparatus is particularly suitable for measuring, with a time resolution of for instance 1 ns (1 GHz), the time profile, in particular the duration of a pulse (expressed in FWHM—full width at values equal to half the maximum value), in the infrared region (for which the wavelength $\lambda$ is greater than approximately 1.1 $\mu$m).

In yet another embodiment of an apparatus according to the invention for detecting a photon pulse in the X-ray region the gaseous medium contains particles for bringing into an Auger state in order to absorb the photon pulse and to emit a primary electron stream with a determined primary electron energy and to emit, in an Auger state, a secondary electron stream with a determined secondary electron energy which differs from the primary electron energy, and second deflection means are provided for deflecting the primary and secondary electron stream in a direction differing from that of the deflection by the first deflection means, in a manner such that the primary electron stream is separated from the secondary electron stream and substantially only the deflection of the second electron stream is determined with the position-sensitive detector.

During incidence of an X-ray pulse for detecting into such an apparatus, an inner shell electron is liberated from the particles, in particular atoms, which on the one hand results in a primary stream of electrons with a determined primary energy and on the other causes a hole in the relevant inner shell of the atoms which are now in an Auger state, which hole is filled by a radiation-free transition of an electron from the outer shell. The energy released in this latter transition is absorbed by a second electron from the outer shell, which electron is liberated and results in a secondary stream of electrons with a determined secondary energy which in principle differs from the above mentioned primary energy. Because the energy of the primary electrons differs in principle from that of the secondary electrons, the time during which the primary and secondary electrons are subject to the action of the second deflection means also differs, whereby it is possible to deflect the primary electrons such that they do not reach the position-sensitive detector and to deflect the secondary electrons such that they do reach the position-sensitive detector. Only in the chance situation where the energy of the primary electrons is the same as that of the secondary electrons would primary and secondary electrons be deflected to the same degree. However, using knowledge of the wavelength(s) of the X-ray pulse for detecting and the spectrum of the Auger atom, such a situation can be prevented in practical situations in simple manner by choosing a different, suitable Auger atom.

In an apparatus according to the invention for detecting an X-ray pulse the second deflection means are preferably provided to deflect the primary and secondary electron stream in a direction substantially perpendicular to the direction of the deflection by the first deflection means. In such an apparatus the secondary electron stream, which corresponds with the intensity of the incident X-ray pulse, is displayed on the position-sensitive detector as a function of time in a determined direction as a line segment, the intensity of which is a measure for the intensity of the X-ray pulse, while the primary electron stream is deflected in a direction perpendicular to that of this line segment and outside the sensitivity range of the position-sensitive detector. For instance a slit in the path of the primary electrons brings about blocking of these electrons, i.e. the primary electrons are prevented from reaching the position-sensitive detector. When the incident X-ray pulse is not monochromatic but comprises a number of wavelengths (for X-rays usually designated with the corresponding energies), the primary electrons emitted by the atoms have as many different energies as the number of wavelengths present in the X-ray pulse, while the secondary electrons are mono-energetic. The non-mono-energetic primary electron stream is deflected to a location outside the position-sensitive detector, while the mono-energetic secondary electron stream produces on the position-sensitive detector a sharp image of the intensity of the incident X-ray pulse as a function of time, which image is neither widened nor otherwise reduced in quality as a result of the distribution in energy of the incident X-ray pulse.

The gaseous medium can in principle contain any atom which can be brought into an Auger state by the relevant photon pulse, for instance Ne (neon).

With a streak camera for the far-infrared region according to the invention photon pulses with a wavelength $\lambda$ up to for instance about $\lambda$=100 $\mu$m can be detected as a function of time with a very high resolution (approximately $10^{-12}$ s.). This makes such a streak camera particularly suitable for for instance measurements of pulse form and pulse duration of ultra-fast lasers, the light emission profile of laser-heated plasmas and nuclear fusion fuel tablets as a function of time, absorption phenomena in solvents, picosecond fluorescence decay in biological preparations, time-dependent medical image signals and dispersion of optical pulses in telecommunication fibres.

A streak camera according to the invention for detecting incident photon pulses offers particular advantages when these pulses are not monochromatic.

The invention will be elucidated hereinbelow on the basis of embodiments and with reference to the drawing.

Figure 1:
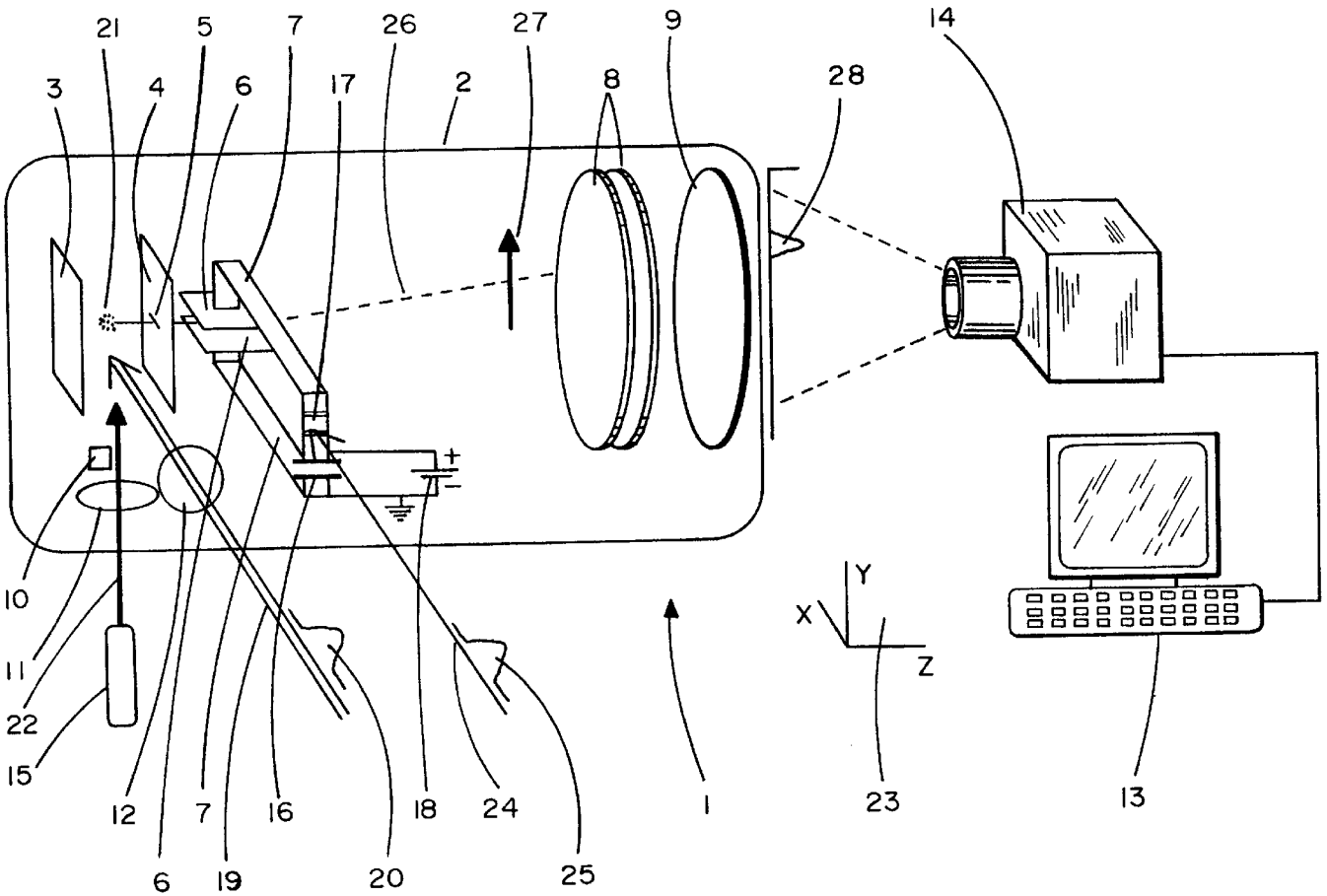
FIG. 1 shows a schematic view of a first embodiment of the invention.

FIG. 1 shows a streak camera 1 for detecting photon pulses in the far-infrared region, with streak tube 2, which comprises cathode plate 3 (connection and supply of which are not shown), collimator plate 4, collimator slit 5, deflection plates 6 with terminals 7, channel plates 8, phosphor screen 9, oven 10 and windows 11,12. The streak camera 1 further comprises a CCD camera 14 coupled to a computer 13 and a diode laser 15. The deflection plates 6 are connected in parallel to a capacitor 16 which can be charged via a GaAs photo switch 17 by a high-voltage supply 18. When the streak camera 1 is in operation a photon pulse 20 (a far-infrared pulse) incident via a window 12 in the direction of arrow 19 is absorbed by a gas 21, which is excited by laser light (represented by arrow 22) from diode laser 15 via window 11 and is in a Rydberg state. The Rydberg gas 21 emits photo-electrons which are accelerated in the z-direction of the shown coordinate system 23 by the cathode plate 3 with a voltage of −5 kV relative to the voltage of collimator plate 4. Via the collimator slit 5 the accelerated photo-electrons move between the deflection plates 6 to which a rapidly increasing voltage is applied via terminals 7 using the high voltage supply 18 and capacitor 16. The deflection voltage on deflection plates 6 is switched using a GaAs photo switch which is activated (indicated by arrow 24) by a light pulse 25 derived from the photon pulse 20 and running synchronously therewith. The electron stream (represented by dashed line 26) is thus deflected in the direction of arrow 27 as a function of time, is amplified with a factor $10^7$ by the channel plates 8 and strikes the phosphor screen 9, where the electrons are converted into photons at an amplification factor of 10. It is also noted that the rise time of the voltage on deflection plates 6 amounts typically to approximately 5 V/ps, in order to ensure a large displacement per time unit (typically 0.2 mm/ps) on phosphor screen 9. Thus displayed on phosphor screen 9 is a line segment of which the intensity (schematically represented by curve 28) corresponds with that of the incident photon pulse 20. This image is read using CCD camera 14 and processed using computer 13. The sensitivity of the CCD camera is sufficiently high to generate a signal in response to a single incident photo-electron. It will be apparent from FIG. 1 that photo-electrons emitted by Rydberg atoms 21 situated close to the cathode 3 have to cover a longer path to deflection plates 6 than photo-electrons which are emitted by Rydberg atoms 21 which are further removed from cathode 3. However, since the electrons which have to cover a longer path as a consequence of the shorter distance to cathode 3 have a higher energy than the electrons which have to cover a shorter path, the latter electrons are overtaken by the former: there is therefore a point along the path which is covered, the so-called time focus, which is precisely determined, where all photo-electrons emitted at the same point in time by the Rydberg gas arrive simultaneously.

In order to obtain a good sharpness of the image on phosphor screen 9 the deflection plates 6 are for instance placed at the location of this time focus.

The deflection plates 6 are preferably placed just in front of this time focus. Such a placing of deflection plates 6 achieves that the electrons with a higher energy arrive between deflection plates 6 slightly later than the electrons with a lower energy. At this later time of arrival the voltage on deflection plates 6 is higher than at the time of arrival of the electrons with lower energy, so that the electrons with higher energy, which remain between deflection plates 6 for a short time than the electrons with lower energy, undergo a higher deflection voltage than the electrons with lower energy. With a suitably chosen combination of duration of stay of the electrons between the deflection plates and height of the deflection voltage on the plates 6 is achieved that all electrons which are generated in the pulse converter at the same time by the incident photon pulse 20 are deflected at the same angle by deflection plates 6, as a result of which the sharpness of the image on phosphor screen 9 is optimized.

Figure 2:
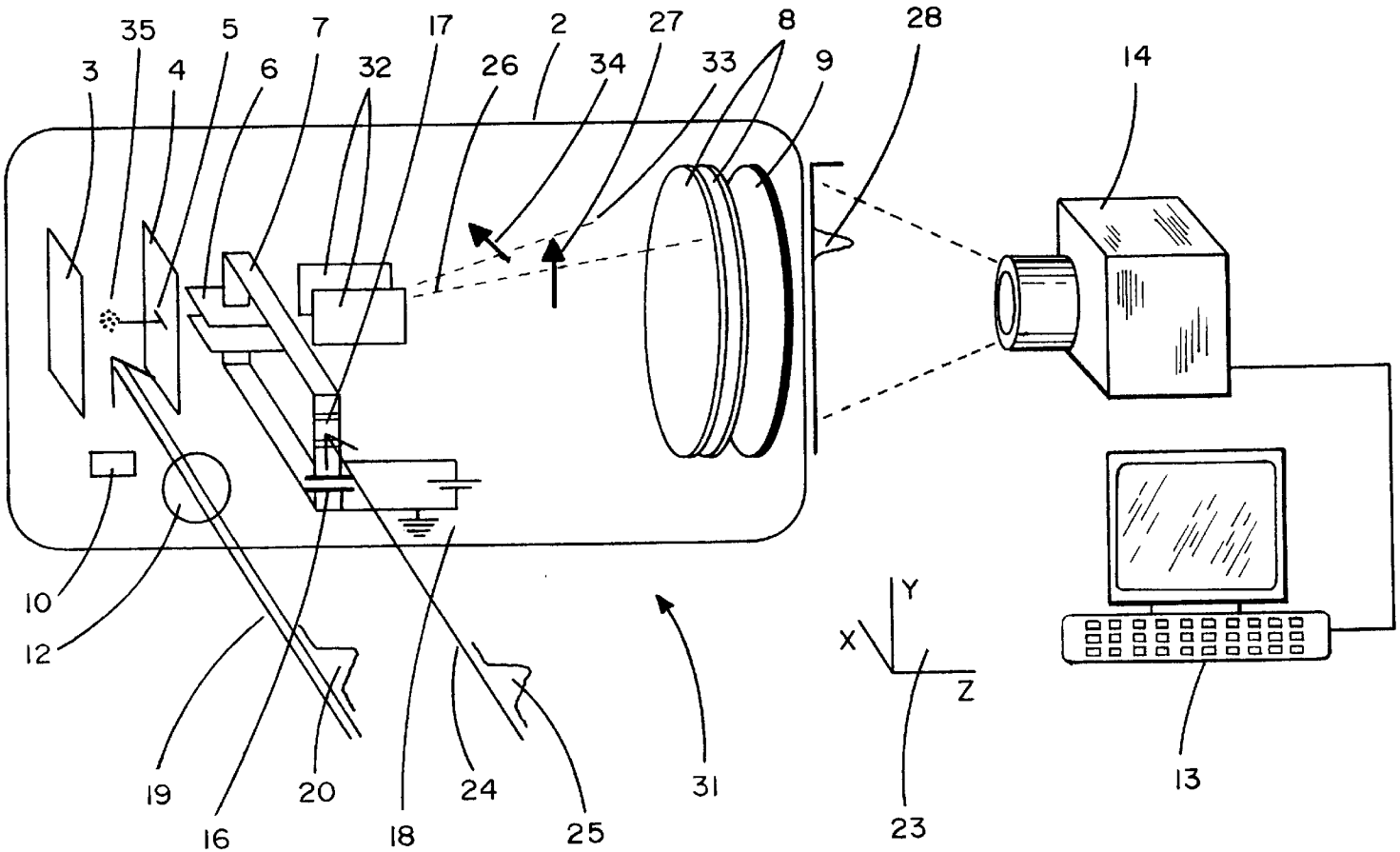
FIG. 2 shows a schematic view of a second embodiment of the invention.

FIG. 2 shows a streak camera 31 for detecting photon pulses in the X-ray region. Parts corresponding with the streak camera 1 shown in FIG. 1 are designated with the same reference numerals and will not be discussed again here. The present streak camera 31 differs from the streak camera 1 of FIG. 1 in the presence of deflection plates 32 for deflecting in the x-direction the primary and secondary electron stream emitted by Auger atoms 35. Deflection plates 32 are connected via terminals (not shown) to a direct voltage source (not shown). Because the energy of primary and secondary electrons differs, the duration of stay of the primary and secondary electrons between deflection plates 32 also differs. The deflection voltages and positioning and dimensioning of the parts of the different components of streak camera 31 are chosen such that, after deflection in y-direction (arrow 27) as a function of time, the secondary electron stream (represented by dashed line 26) is amplified by the channel plates 8 by a factor $10^7$ and strikes phosphor screen 9, while the primary electron stream (represented by dashed line 33) is deflected in x-direction (arrow 34) such that it does not strike phosphor screen 9. A line segment is thus displayed in y-direction on phosphor screen 9, which line segment is slightly widened in x-direction as a consequence of the deflection of the electrons by deflection plates 32, but the intensity of which (represented schematically by curve 28) corresponds with the incident photon (in this case X-ray) pulse 20.

Figure 3:
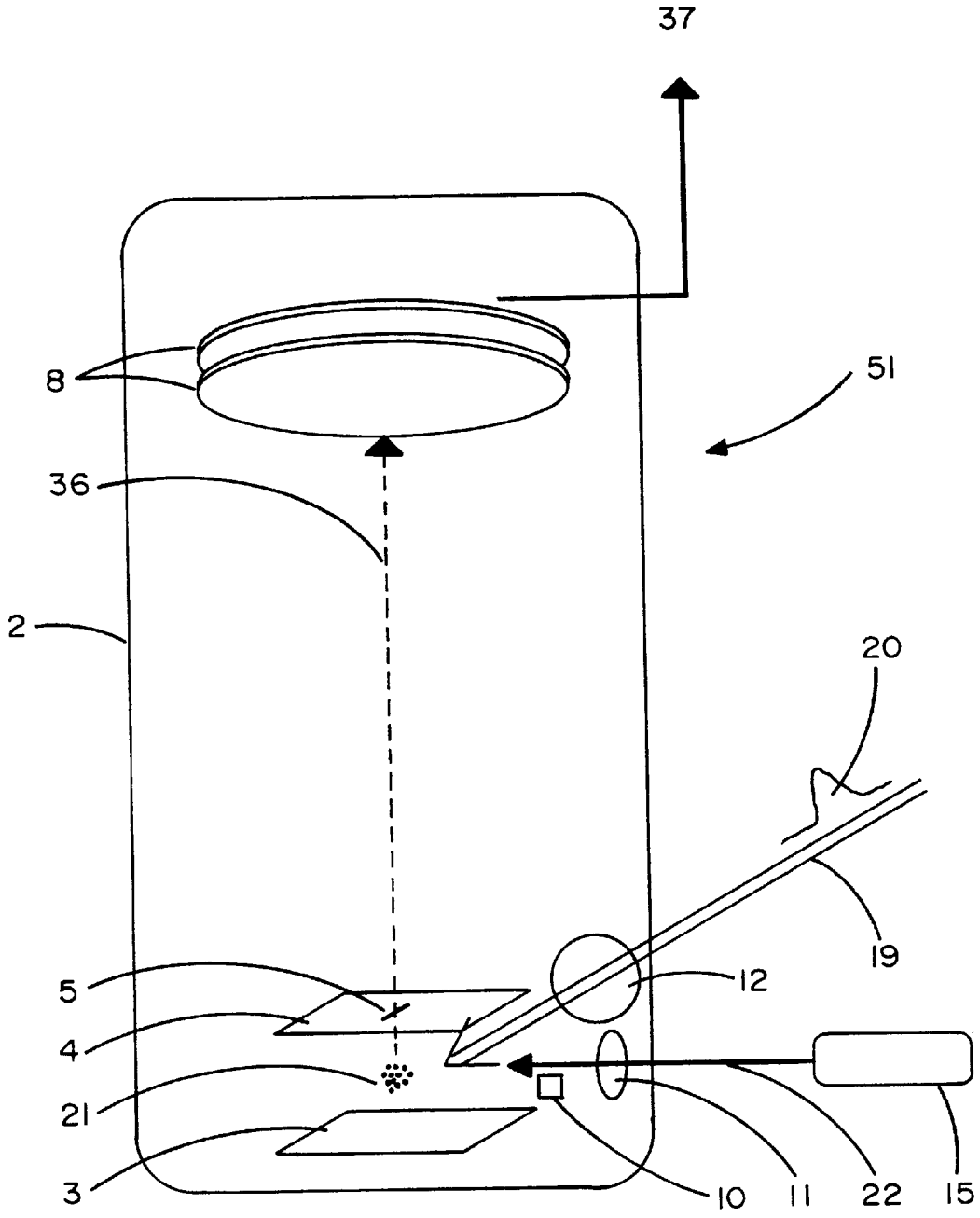
FIG. 3 shows a schematic view of a third embodiment of the invention.

FIG. 3 shows a photon detector 51 for detecting photon pulses in the wavelength range with a wavelength $\lambda$ greater than about 1.1 $\mu$m. Parts corresponding with the streak camera 1 shown in FIG. 1 are designated with the same reference numerals and will not be discussed again here. The present photon detector 51 differs from streak camera 1 of FIG. 1 by the absence of deflection plates and a phosphor screen. In the detector 51 electrons (represented by dashed line 36) created by photo-ionization of the Rydberg atoms 21 excited by using a laser 15, pass directly via collimator slit 5 to an electron detector, which in this example comprises a pair of micro-channel plates 8 but which may also comprise a so-called channeltron or other suitable electron detector. The electron detector 8 generates an electric current 37 which is proportional to the number of incoming electrons, which current 37 can also be measured as a function of time, for instance using an oscilloscope. To prevent the condensation of gas on micro-channel plates 8 these plates are preferably heated during use. In addition or by way of alternative the collimator slit 5 can be covered with a thin foil, for instance Al foil with a thickness of 2 nm, which on the one hand prevents passage of gas particles 21 through the slit 5 but on the other hand allows through electrons or generates secondary electrons which in turn reach the electron detector 8. The arrival time of the electrons 36 at the channel plates 8 is determined in first order approximation by the shape of the time-dependence of the photon pulse 20. This arrival time is focused particularly sharply in time when the position of channel plates 8 is chosen such that the distance from channel plates 8 to collimator slit 5 is just twice the distance from collimator slit 5 to the interaction centre of the Rydberg gas 21. The choice of the laser 15 and the Rydberg gas 21 is determined by the wavelength of the photon pulse 20 for measuring. A photon pulse 20 with a wavelength $\lambda$<1635 nm for instance ionizes an Na gas in the Rydberg state 5*p*. The Na gas can be brought into this Rydberg state by excitation with a laser having a wavelength of 285 nm. A photon pulse 20 with a wavelength $\lambda$<35 $\mu$m ionizes for instance an Rb gas in the Rydberg state 20*f*. The Rb gas can be brought into the respective Rydberg states 5*p*, 5*d* and 20*f* by successive excitations with diode lasers at wavelengths of respectively 780 nm, 776 nm and 1299 nm.

Figure 4:
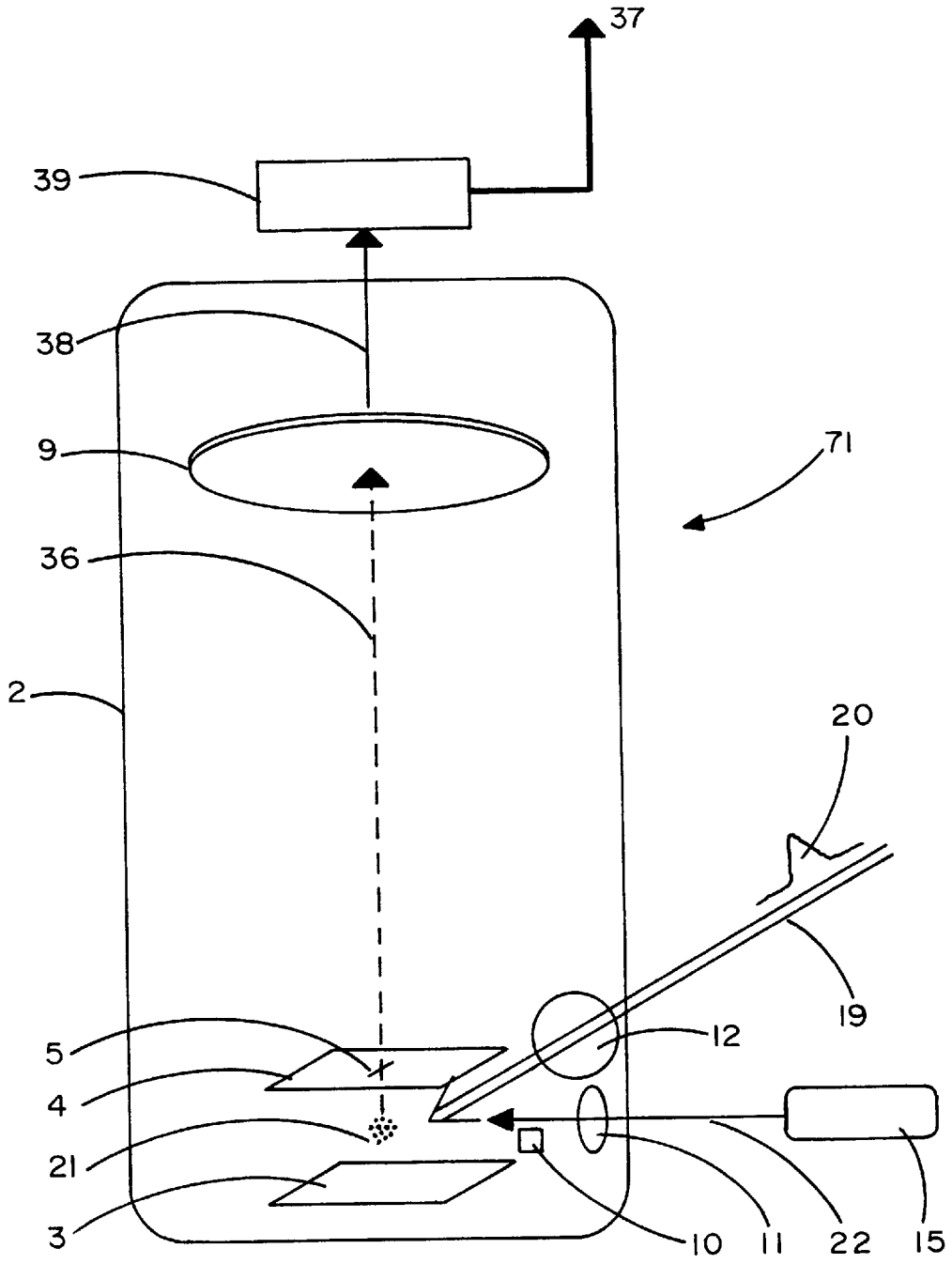
FIG. 4 shows a schematic view of a fourth embodiment of the invention.

FIG. 4 shows an alternative embodiment 71 of the photon detector of FIG. 3, in which detection of photo-electrons 36 takes place using a phosphor screen 9 which converts the electron stream 36 into a photon stream 38, which is measured again outside tube 2 using a photo detector 39 for the visible range, for instance a photo-multiplier tube or an image intensifier, which again produces a signal 37 representative of the incident photon pulse 20.

We claim:

1. Apparatus for detecting a photon pulse as a function of time, comprising a pulse converter for converting a photon pulse to be detected into an electron stream, first deflection means for deflecting the electron stream as a function of time and a position-sensitive detector for determining the deflection of the electron stream, characterized in that the pulse converter comprises a gaseous medium in order to absorb the photon pulse for detecting and to emit the electron stream.

2. Apparatus as claimed in claim 1, wherein the photon pulse lies in the far-infrared region, characterized in that the apparatus is provided with excitation means for bringing particles into an excited electron state and the gaseous medium contains particles to be brought into the said excited electron state in order to absorb the photon pulse and to emit the electron stream.

3. Apparatus for detecting a photon pulse in the infrared region as a function of time, comprising a pulse converter for converting a photon pulse for detecting into an electron stream and a detector for this electron stream, characterized in that the apparatus is provided with excitation means for bringing particles into an excited electron state and the pulse converter comprises a gaseous medium with particles for bringing into this excited electron state in order to absorb the photon pulse and to emit the electron stream.

4. Apparatus as claimed in claim 2, characterized in that the excited electron state is a Rydberg state.

5. Apparatus as claimed in claim 2, characterized by an evaporation oven for bringing into gaseous state the particles for bringing into an excited electron state.

6. Apparatus as claimed in claim 2, characterized in that the particles are alkali metal atoms.

7. Apparatus as claimed in claim 6, characterized in that the alkali metal atoms comprise one of the elements Rb (rubidium) or Cs (caesium).

8. Apparatus as claimed in claim 2, characterized in that the excitation means comprise a laser light source.

9. Apparatus as claimed in claim 8, characterized in that the laser light source is a dye laser pumped with an Nd:YAG (neodymium:yttrium-aluminium garnet) laser.

10. Apparatus as claimed in claim 8, characterized in that the laser light source is a diode laser.

11. Apparatus as claimed in claim 1, wherein the photon pulse is an X-ray pulse, characterized in that the gaseous medium contains particles to be brought into an Auger state in order to absorb the photon pulse and to emit a primary electron stream with a determined primary electron energy and to emit, in an Auger state, a secondary electron stream with a determined secondary electron energy which differs from the primary electron energy, and second deflection means are provided for deflecting the primary and secondary electron stream in a direction differing from that of the deflection by the first deflection means, in a manner such that the primary electron stream is separated from the secondary electron stream and substantially only the deflection of the second electron stream is determined with the position-sensitive detector.

12. Apparatus as claimed in claim 11, characterized in that the second deflection means are provided to deflect the primary and secondary electron stream in a direction substantially perpendicular to the direction of the deflection by the first deflection means.

13. Apparatus as claimed in claim 11, characterized in that the particles for emitting the secondary electron stream in an Auger state are Ne (neon) atoms.

14. Apparatus as claimed in claim 1, characterized in that there is a first deflection means present at a location where the electrons for deflecting by said first deflection means emitted at a determined point in time by the gaseous medium arrive simultaneously.

15. Apparatus as claimed in claim 1, characterized in that there is a first deflection means present at a location between the pulse convertor and the position at which the electrons for deflecting by said first deflection means emitted at a determined point in time by the gaseous medium arrive simultaneously.

* * * * *